US006641362B1

(12) United States Patent
Anding et al.

(10) Patent No.: US 6,641,362 B1
(45) Date of Patent: Nov. 4, 2003

(54) COMPONENT THAT CAN BE SUBJECTED TO HOT GAS, ESPECIALLY IN A TURBINE BLADE

(75) Inventors: Dirk Anding, Karlsfeld (DE); Hans-Thomas Bolms, Mülheim a.d. Ruhr (DE); Michael Scheurlen, Mülheim a.d. Ruhr (DE); Michael Strassberger, München (DE); Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/030,236

(22) PCT Filed: Jun. 15, 2000

(86) PCT No.: PCT/EP00/05525

§ 371 (c)(1),
(2), (4) Date: Dec. 28, 2001

(87) PCT Pub. No.: WO01/00965

PCT Pub. Date: Jan. 4, 2001

(30) Foreign Application Priority Data

Jun. 28, 1999 (EP) ..... 99112370

(51) Int. Cl.[7] ..... F01D 5/08
(52) U.S. Cl. ..... 415/115; 416/97 R
(58) Field of Search ..... 415/115; 416/97 R

(56) References Cited

U.S. PATENT DOCUMENTS

| | | | | |
|---|---|---|---|---|
| 4,627,480 A | | 12/1986 | Lee | |
| 5,413,458 A | | 5/1995 | Calderbank | |
| 5,681,144 A | * | 10/1997 | Spring et al. | 416/97 R |
| 5,695,321 A | | 12/1997 | Kercher | |
| 5,695,322 A | * | 12/1997 | Jacobson et al. | 416/97 R |
| 5,700,132 A | * | 12/1997 | Lampes et al. | 416/97 R |
| 6,056,508 A | * | 5/2000 | Johnson et al. | 416/96 R |

FOREIGN PATENT DOCUMENTS

| | | |
|---|---|---|
| EP | 0825332 | 2/1998 |
| EP | 0758932 | 6/1998 |
| EP | 0852285 | 7/1998 |
| EP | 0892150 | 1/1999 |
| WO | WO 95/28243 | 10/1995 |

* cited by examiner

*Primary Examiner*—Ninh H. Nguyen
(74) *Attorney, Agent, or Firm*—Harness, Dickey & Pierce, P.L.C.

(57) ABSTRACT

A component can be subjected to hot gas. At least one duct is provided which can be subjected to a cooling fluid. The duct is bounded by two first walls opposite to one another. The walls include turbulators with the same direction of inclination. In order to avoid constrictions, the turbulators of the first wall have a different angle of inclination relative to a flow direction of the cooling fluid to the turbulators of the second wall.

17 Claims, 4 Drawing Sheets

COMPONENT THAT CAN BE SUBJECTED TO HOT GAS, ESPECIALLY IN A TURBINE BLADE

This application is the national phase under 35 U.S.C. § 371 of PCT International Application No. PCT/EP00/05525 which has an International filing date of Jun. 15, 2000, which designated the United States of America, the entire contents of which are hereby incorporated by reference.

FIELD OF THE INVENTION

The present invention relates to a component, preferably a turbine blade/vane, which can be subjected to hot gas. More preferably, it relates to one which has at least one duct which can be subjected to a cooling fluid and is bounded by two first walls opposite to one another. The walls are preferably provided with one or more turbulators to improve the heat transfer between the component and the cooling fluid. The turbulators of the first wall and the turbulators of the second wall preferably have the same direction of inclination and being inclined relative to a flow direction of the cooling fluid by an angle of inclination.

BACKGROUND OF THE INVENTION

A component, in the embodiment as a gas turbine blade/vane, is known from EP 0 758 932 B1 or U.S. Pat. No. 5,695,321, in particular FIG. 9A. The known gas turbine blade/vane has a hollow configuration and has at least one duct, which can be subjected to a cooling fluid. By this, the inlet temperature of the gas into the gas turbine can be increased so that the efficiency is improved. The duct is bounded by two first walls opposite to one another. One or more turbulators, which improve the heat transfer between the gas turbine blade/vane and the cooling fluid, are provided on these walls. The turbulators of the two walls have the same direction of inclination and are inclined by the same angle of inclination relative to a flow direction of the cooling fluid. In such an embodiment, the duct can be locally constricted by the turbulators. This particularly occurs when the two walls located opposite to one another, and therefore the turbulators, have different lengths. Sections of the turbulators of the two walls are then located opposite to one another at the same height. At this location, the duct is locally constricted.

Because, in the usual case, each wall is provided with a plurality of turbulators, this constriction occurs repeatedly. There is not, therefore, a cooling fluid flow with an essentially constant cross section oscillating uniformly from one wall to the other. The cross section available for the cooling fluid is, rather, continuously varied so that pressure losses occur.

U.S. Pat. No. 5,413,458 shows a gas turbine guide blade with a platform. The platform is provided with a flow chamber in which turbulators are arranged in such a way that cooling fluid flowing through the flow chamber is guided to the corners of the platform.

SUMMARY OF THE INVENTION

An object of the present invention is, therefore, to provide a component which can be subjected to hot gas. Preferably, a component is provided in which an essentially uniform duct cross section is present, without local constrictions, over the complete length of the turbulators.

This object is preferably achieved, according to the invention and in a component, by the angle of inclination of the turbulators of the first wall being different from the angle of inclination of the turbulators of the second wall.

The different angles of inclination of the turbulators of the first and second walls permit an arrangement of the turbulators without local constrictions. Because of the different angles of inclination, there are no longer any sections of the turbulators opposite to one another. The turbulators of one wall can, rather, be arranged to alternate almost entirely over its complete length, with the turbulators of the other wall. This provides a uniform cross section of the duct for the cooling fluid in the direction of the length of the turbulators. The changes in cross section, and the pressure losses associated with them, occurring in the case of the known designs are essentially reduced.

Advantageous embodiments and developments of the invention are given in the subclaims.

The length of the first wall is advantageously greater than the length of the second wall. Different cross sections can, by this, be selected for the component which can be subjected to hot gas.

In an advantageous development, the first two walls have a curved configuration. By way of the curved walls, a cross section in the shape of an aerofoil section can be selected for for the component which can be subjected to hot gas. This cross section is preferred, in particular, for the application as a turbine blade/vane.

In an advantageous embodiment, the angle of inclination of the turbulators of the first wall is greater than the angle of inclination of the turbulators of the second wall. The length of the turbulators of the first wall is reduced by this, whereas the length of the turbulators of the second wall is increased. In this arrangement, the angles of inclination are selected in such a way that the turbulators on the two walls are arranged so that they alternate almost completely with one another. This leads to an essentially uniform cross section of the duct over the complete length of the turbulators.

Two further walls are advantageously provided to form boundaries for the duct, which walls connect the two first walls to one another. The internal space of the component which can be subjected to hot gas is subdivided by these two further walls into a plurality of ducts, for example three, which ducts are in connection with one another. The cooling fluid flows sequentially through the three ducts. When used as a gas turbine blade/vane, the first duct—in which the temperature of the cooling fluid is lowest—is advantageously arranged at the inlet flow end of the gas turbine blade/vane.

In an advantageous development, the two further walls are arranged at an angle relative to one another. This angular arrangement permits an alignment of these further walls essentially at right angles to the two first walls. This alignment leads to an optimized guidance of the cooling fluid. The angled location of the two further walls is, furthermore, more suitable for accepting loads in the application as a gas turbine blade/vane.

In a first advantageous embodiment, the turbulators preferably have a straight configuration. This straight configuration facilitates removal from the mold of the component according to the invention and makes the manufacturing process cheaper.

In a further advantageous embodiment, the turbulators preferably have a curved configuration. Curved turbulators permit complete alternation of the turbulators over their entire length. The pressure losses due to changes in cross section are minimized to the greatest extent possible.

BRIEF DESCRIPTION OF THE DRAWINGS

The invention is explained in more detail below using embodiment examples, which are represented in a diagrammatic manner in the drawing. The component according to the invention is here described using a gas turbine blade/vane as an example. This should not be understood as a limitation to the scope of the invention. In the drawings.

DETAILED DESCRIPTION OF THE PREFERRED EMBODIMENTS

Figure 1:
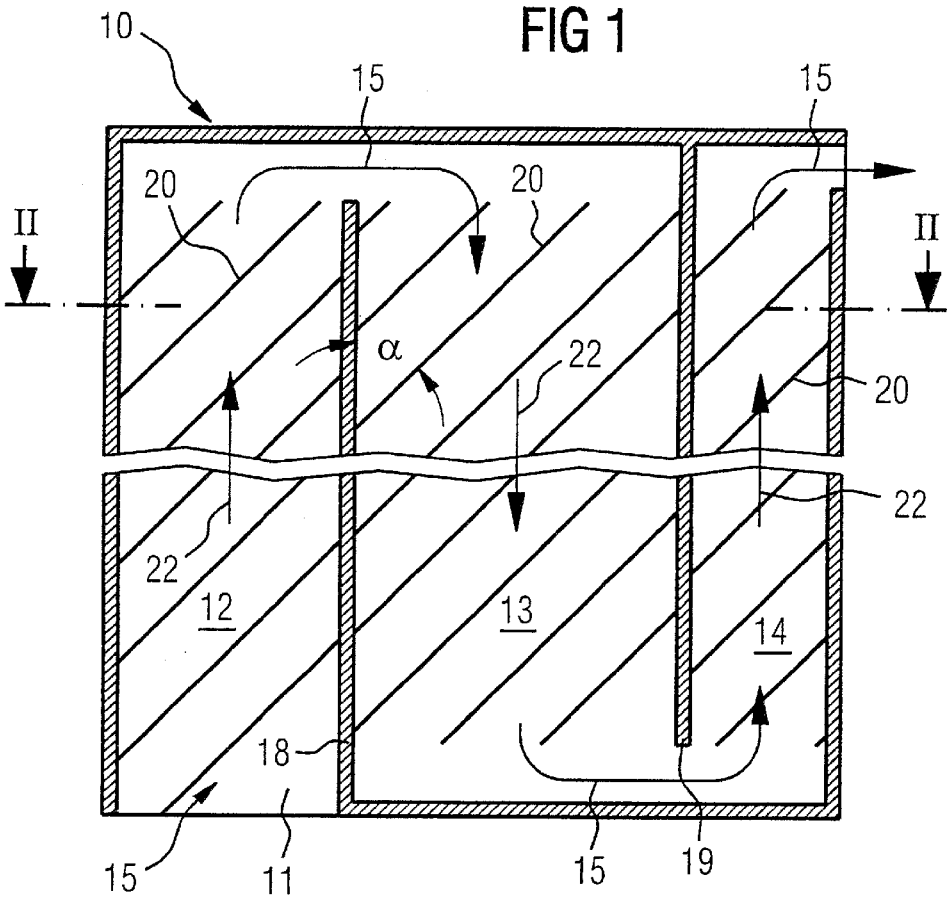
FIG. 1 shows a longitudinal section through a gas turbine blade/vane, along the line I—I in FIG. 2.
Figure 2:
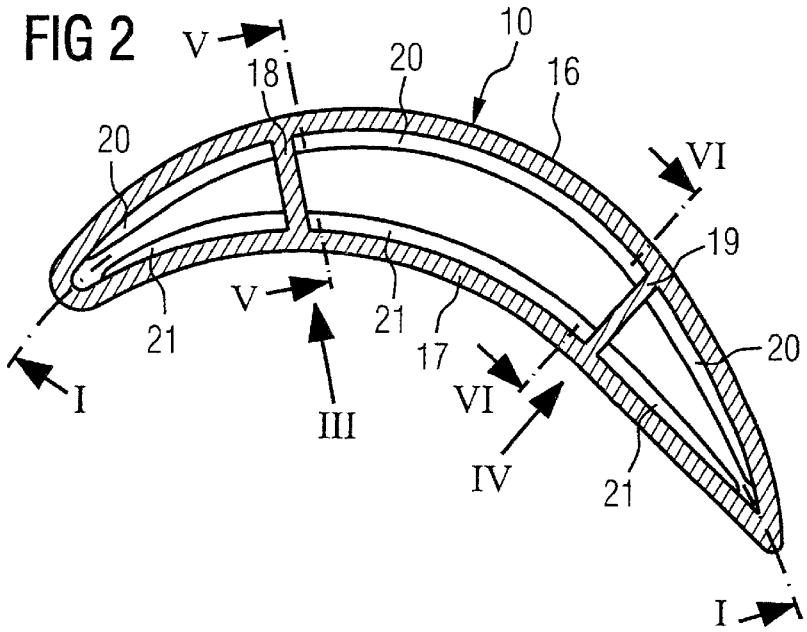
FIG. 2 shows a cross section through a gas turbine blade/vane, along the line II—II in FIG. 1.

A component, preferably a gas turbine blade/vane, 10 is represented in longitudinal section and cross section in FIGS. 1 and 2. Within it, the gas turbine blade/vane 10 has a cooling duct 11, which is subdivided into three individual ducts 12, 13 and 14 extending essentially parallel to one another. A cooling fluid, in particular cooling air, flows through the cooling duct 11 in the direction of the arrow 15.

Each of the three ducts 12, 13 and 14 is bounded by the two outer walls 16 and 17 and one or both separating walls 18 and 19. In order to improve the heat transfer between the cooling fluid and the outer walls 16 and 17, the latter are provided with turbulators 20 and 21.

As may be seen, particularly from FIG. 2, the two outer walls 16 and 17 have a curved configuration and different lengths. The aerofoil section necessary for the gas turbine blade/vane 10 is achieved by this. The outer wall 16 forms the suction surface of the gas turbine blade/vane 10 and the outer wall 17 forms the pressure surface. The two separating walls 18 and 19, which bound the central duct 13, connect the outer walls 16 and 17 to one another. These separating walls 18 and 19 are arranged at an angle relative to one another and are essentially at right angles to the outer walls 16 and 17. Optimization of the guidance of the cooling fluid is achieved by this means. Due to the angular position of the separating walls 18 and 19, at right angles to the outer walls 16 and 17, further loads on the gas turbine blade/vane 10, which occur in operation, can be more satisfactorily accepted.

The turbulators 20 and 21 preferably have the same direction of inclination and are inclined at an angle of inclination relative to a flow direction 22 of the cooling fluid. In the case of the turbulator 20, this is represented by the angle of inclination a in FIG. 1. The flow direction 22 of the cooling fluid in the individual ducts 12, 13 and 14 extends essentially parallel to the separating walls 18 and 19.

In the duct 13, in which the associated region of the outer wall 16 is longer than the associated region of the outer wall 17, the turbulators 20 are likewise longer than the turbulators 21. In the known gas turbine blades/vanes, the turbulators 20 have, relative to the flow direction 22 of the cooling fluid, the same angle of inclination as the turbulators 21 in a projection parallel to one of the two walls 18 and 19. Due to this, sections of the turbulators 20 and 21 can be located opposite to one another at the same height.

Figure 7:
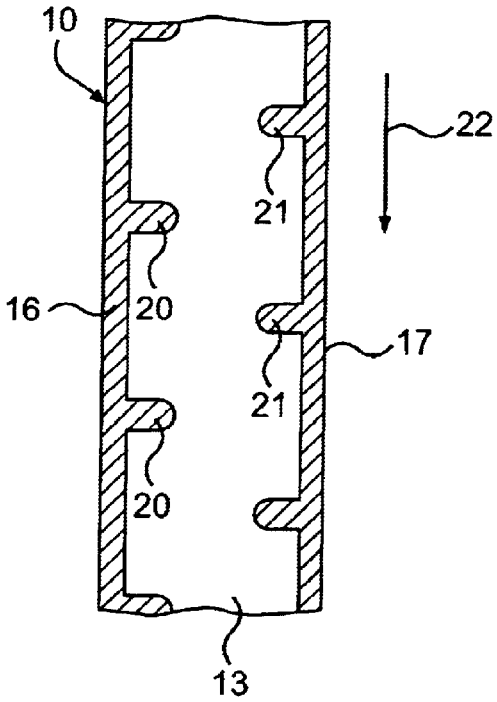
FIG.7 PRIOR ART
FIG. 7 shows a view, similar to FIG. 5, in the case of a gas turbine blade/vane in accordance with the prior art.
Figure 8:
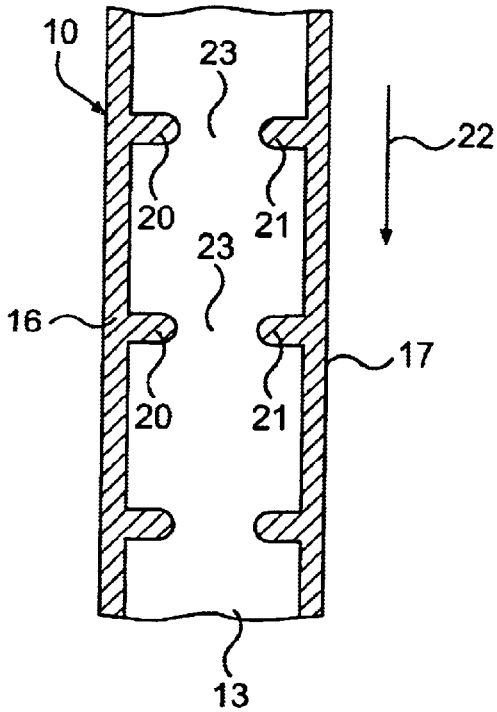
FIG.8 PRIOR ART
FIG. 8 shows a view, similar to FIG. 6, in the case of a gas turbine blade/vane in accordance with the prior art.

FIGS. 7 and 8 show respective sections along the lines V—V and VI—VI, in FIG. 2 for a gas turbine blade/vane 10 in accordance with the prior art. On the left-hand side of the duct 13 in FIG. 2, which is represented in cross section in FIG. 7, the turbulators 20 and 21 of the two outer walls 16 and 17 are arranged alternately relative to one another. In this region, the cooling fluid can oscillate uniformly from one outer wall 16 to the other outer wall 17. In the right-hand region in FIG. 2, which is represented in cross section in FIG. 8, the two turbulators 20 and 21 are located at the same height relative to one another. A uniformly oscillating cooling fluid flow is no longer possible. Constrictions 23 are, rather, formed between the turbulators 20 and 21. Due to this, the cross section available for the cooling fluid varies continuously. This variation in cross section leads to pressure losses and, therefore, to a locally reduced cooling effectiveness and overheating.

In contrast, the invention provides for an arrangement of the turbulators 20 and 21 with the same direction of inclination but different angles of inclination relative to the flow direction 22. This is shown more clearly in FIGS. 3 and 4, which respectively show views in the direction of the separating walls 18 and 19. The turbulators 20 and 21 have the same direction of inclination on the two outer walls 16 and 17, namely from lower on the left to higher on the right. For easier viewing, the outer wall 17 is not represented in FIGS. 3 and 4.

Figure 3:
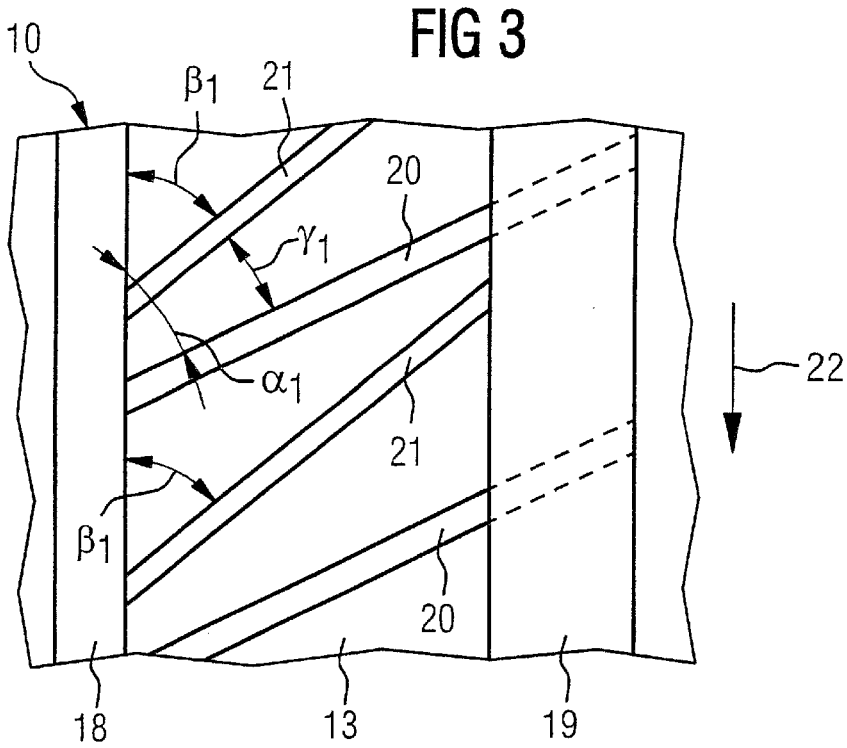
FIG. 3 shows a view in the direction of the arrow III of FIG. 2.

In the view shown in FIG. 3, the separating wall 18 appears undistorted with respect to width. Because of the viewing direction, the separating wall 19 is correspondingly distorted and is therefore shown wider. The turbulators 20 extend from the separating wall 18 to the separating wall 19 along the first wall 16. In the view of FIG. 3, therefore, they are covered at some points in the right-hand region by the separating wall 19. The turbulators 21 extend along the outer wall 17 between the separating walls 18 and 19. Because of the different lengths of the outer walls 16 and 17 and the angular positions of the separating walls 18 and 19, the turbulators 20 and 21 have different lengths.

In order to avoid constrictions, the angle of inclination $\alpha$ of the turbulators of the first outer wall 16 are selected to be larger than the angle of inclination $\beta$ of the turbulators 21 of the second outer wall 17. This reduces the actual length of the turbulators 20, whereas the length of the turbulators 21 is increased. There is, therefore, an angular difference $\gamma$ between the turbulators 20 and 21.

Figure 4:
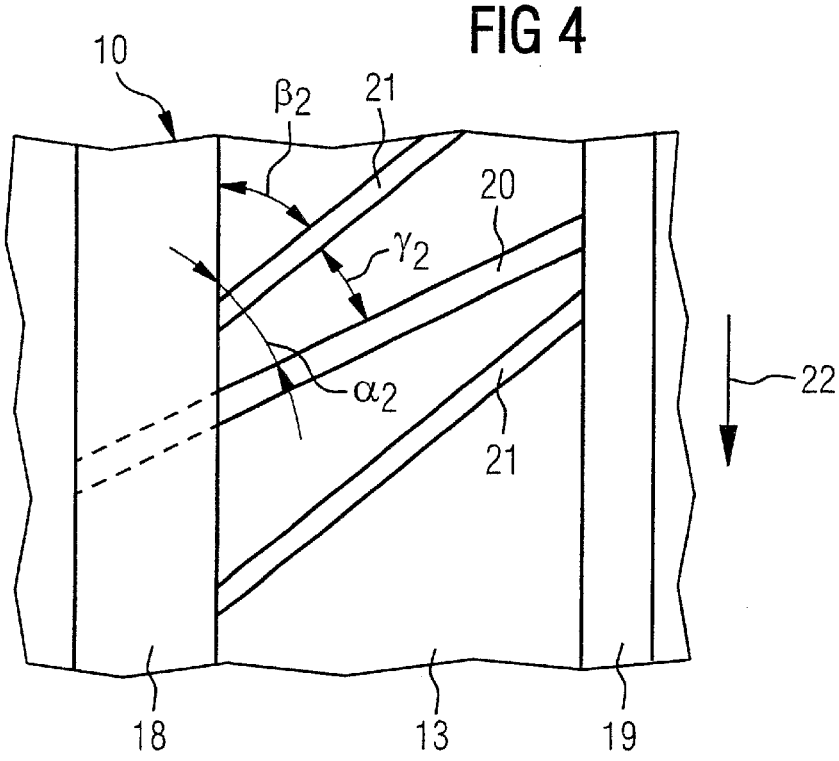
FIG. 4 shows a view in the direction of the arrow IV of FIG. 2.

FIG. 4 shows a view in the direction of the separating wall 19. Correspondingly, the separating wall 19 appears undistorted, whereas the separating wall 18 appears to be wider because of the viewing direction. The angular difference $\gamma$ between the turbulators 20 and 21, because of the different angles of inclination $\alpha$ and $\beta$, can be clearly recognized.

FIGS. 3 and 4 reproduce the positions of the turbulators 20 and 21 from different viewing angles. Because of these different viewing angles, different angles of inclination and angular differences appear in FIGS. 3 and 4 and these angles and angular differences are correspondingly designated by $\alpha_1$, $\alpha_2$, $\beta_1$, $\beta_2$ and $\gamma_1$, $\gamma_2$. The type and the magnitude of the distortion then depends on the individual case.

The different angles of inclination $\alpha$ and $\beta$, but the same direction of inclination, of the turbulators 20 and 21 provide almost complete alternation of the turbulators. As represented in FIGS. 3 and 4, there is practically no position at which the turbulators 20 and 21 are opposite to one another. The cooling fluid can therefore oscillate unhindered from one outer wall 16 to the other outer wall 17. This applies both close to the separating wall 18 and close to the separating wall 19.

Figure 5:
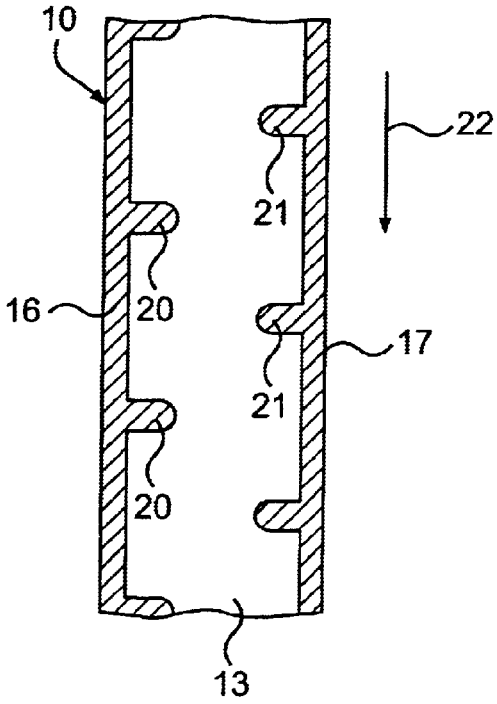
FIG. 5 shows a section along the line V—V in FIG. 2.
Figure 6:
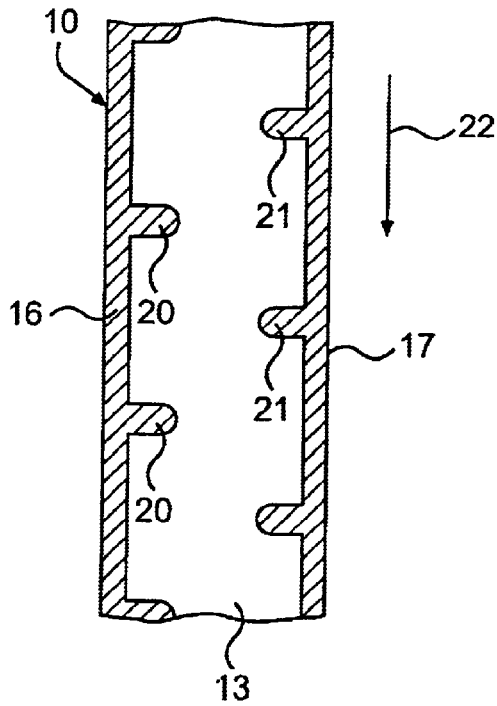
FIG. 6 shows a section along the line VI—VI in FIG. 2.

The relationships close to the separating walls 18 and 19, corresponding to the section lines V—V and VI—VI in FIG. 2, are represented in FIGS. 5 and 6. It may be clearly seen that the constriction 23, which is present in the case of the prior art, no longer occurs in the case of the gas turbine blade/vane 10 according to the invention. This is achieved by means of the different angles of inclination α and β of the turbulators 20 and 21 for the same direction of inclination.

The use of straight turbulators 20 and 21, as shown in FIGS. 3 and 4, permits low-cost manufacture of the gas turbine blade/vane 10. Complete alternation of the turbulators 20 and 21 is only possible with straight turbulators in the case of parallel separating walls 18 and 19. The distance apart of the turbulators 20 and 21 near the separating wall 18 is different from their distance apart near the separating wall 19. Complete central alternation can be achieved by the use of curved turbulators 20 and 21. This is, in particular, represented in FIG. 9. In addition, a uniform distance d between the turbulators 20 and 21 can be achieved along the complete length of the turbulators 20 and 21 by means of curved turbulators 20 and 21. This provides optimum oscillation of the cooling fluid flow between the two outer walls 16 and 17. As a comparison, the position of the turbulators 20 and 21 relative to one another is shown in FIG. 10 in the case of a gas turbine blade/vane 10 in accordance with the prior art, when the separating walls 18 and 19 are not parallel and the distancing of the separating walls 18 takes place. It may be clearly seen that the turbulators 20 and 21 are opposite to one another near the separating wall 19. This forms the constriction 23 represented in FIG. 8.

Figure 9:
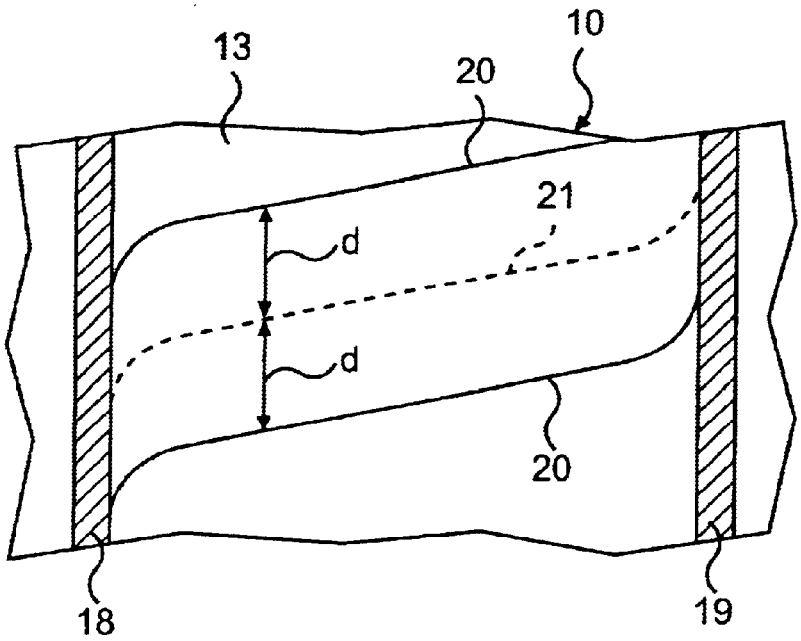
FIG. 9 shows a view, similar to FIG. 1, in the case of a gas turbine blade/vane according to the invention.
Figure 10:
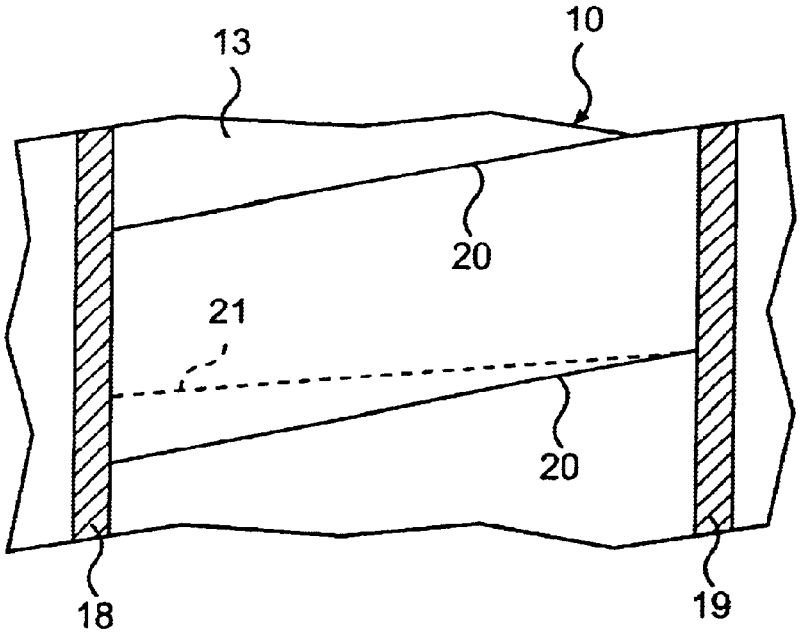
FIG.10 PRIOR ART
FIG. 10 shows a view, similar to FIG. 9, in the case of a gas turbine blade/vane in accordance with the prior art.

The angular variation of the turbulators 20 and 21 in FIGS. 9 and 10 relative to the flow direction 22 may be attributed to the projection direction selected. Both FIG. 9 and FIG. 10 show a diagrammatic projection of the duct 13 onto the plane along the section line I—I in FIG. 2. In this projection, the uniform variation represented in FIG. 9 appears in the arrangement of the turbulators 20 and 21 according to the invention.

The apparently different angle of inclination of the turbulators 20 and 21 in FIG. 10 and the apparently uniform angle of inclination in FIG. 9 may be attributed to the distortion due to the projection. Because of this distortion, the turbulators 20 and 21 in both FIGS. 9 and 10 appear to be equally long despite their actual difference in length.

Overall, the invention permits a uniform cross section of the duct 11 over the complete length of the turbulators 20 and 21.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A component which can be subjected to hot gas, comprising:

at least one duct which can be subjected to a cooling fluid; and two walls opposite to one another, bounding the at least one duct, the walls being provided with one or more turbulators to improve the heat transfer between the component and the cooling fluid, the at least one turbulator of the first wall and the at least one turbulator of the second wall having the same direction of inclination, and being inclined relative to a flow direction of the cooling fluid by an angle of inclination; wherein the angle of inclination of the at least one turbulator of the first wall is greater than the angle of inclination of the at least one turbulator of the second wall, and wherein the length of the first wall is greater than the length of the second wall.

2. The component as claimed in claim 1, wherein the first two walls have a curved configuration.

3. The component as claimed in claim 2, wherein the angle of inclination of the at least one turbulator of the first wall is greater than the angle of inclination of the at least one turbulator of the second wall.

4. The component as claimed in claim 2, wherein two further walls are provided to form boundaries for the at least one duct, which walls connect the two first walls to one another.

5. The component as claimed in claim 1, wherein two further walls are provided to form boundaries for the at least one duct, which walls connect the two first walls to one another.

6. The component as claimed in claim 5, wherein the two further walls are arranged at an angle relative to one another.

7. The component as claimed in claim 1, wherein the turbulators have a straight configuration.

8. The component as claimed in claim 1, wherein the turbulators have a curved configuration.

9. The component as claimed in claim 1, wherein two further walls are provided to form boundaries for the at least one duct, which walls connect the two first walls to one another.

10. The component of claim 1, wherein the component is a turbine blade.

11. The component of claim 1, wherein the component is a turbine vane.

12. A component which can be subjected to hot gas, comprising:

at least one duct which can be subjected to a cooling fluid; and two walls opposite to one another, bounding the at least one duct, the walls being provided with one or more turbulators to improve the heat transfer between the component and the cooling fluid, the at least one turbulator of the first wall and the at least one turbulator of the second wall having the same direction of inclination, and being inclined relative to a flow direction of the cooling fluid by an angle of inclination, wherein the angle of inclination of the at least one turbulator of the first wall is different from the angle of inclination of the at least one turbulator of the second wall, wherein two further walls are provided to form boundaries for the at least one duct, which walls connect the two first walls to one another and wherein the two further walls are arranged at an angle relative to one another.

13. The component as claimed in claim 12, wherein the first two walls have a curved configuration.

14. The component as claimed in claim 12, wherein the turbulators have a straight configuration.

15. The component as claimed in claim 12, wherein the turbulators have a curved configuration.

16. The component of claim 12, wherein the component is a turbine blade.

17. The component of claim 12, wherein the component is a turbine vane.

* * * * *